United States Patent [19]

Johnson

[11] 4,121,527

[45] Oct. 24, 1978

[54] HOOK DRIVE FOR SEWING MACHINES

[75] Inventor: Ralph E. Johnson, Convent Station, N.J.

[73] Assignee: The Singer Company, New York, N.Y.

[21] Appl. No.: 717,054

[22] Filed: Aug. 23, 1976

[51] Int. Cl.[2] ..... D05B 57/14

[52] U.S. Cl. ..... 112/182; 112/184; 112/220

[58] Field of Search ..... 112/182, 184, 190, 191, 112/220, 228, 231, 241

[56] References Cited

U.S. PATENT DOCUMENTS

| | | | |
|---|---|---|---|
| 2,148,385 | 2/1939 | Waterman | 112/184 |
| 3,373,707 | 3/1968 | Ketterer | 112/231 X |
| 3,420,200 | 1/1969 | Johnson | 112/182 X |
| 3,628,479 | 12/1971 | Schafer | 112/184 X |
| 3,693,556 | 9/1972 | Ketterer | 112/184 |
| 3,804,042 | 4/1974 | Ross | 112/182 X |
| 3,894,499 | 7/1975 | Hamlett | 112/231 X |

OTHER PUBLICATIONS

G. M. Pfaff Parts Catalog, Mar. 1950, pp. 10–11.

*Primary Examiner*—Werner H. Schroeder
*Assistant Examiner*—Moshe I. Cohen
*Attorney, Agent, or Firm*—Robert E. Smith; Edward L. Bell; Julian Falk

[57] ABSTRACT

This disclosure relates to hook drive mechanisms for sewing machines and in particular to a hook drive mechanism wherein the hook member is freely supported by a bearing means in a hook support plate carried by the bed portion of the frame and is driven by a likewise freely supported drive member. The support plate with the hook member is supported for relative adjustment with the needle for adjusting the hook point-to-needle relationship. The hook member is readily removable in that it is freely supported in the aforementioned bearing means and is otherwise only restrained by a movable restraining means carried by a hook member cover plate which when removed from restraining relationship permits the bobbin and the hook member to be easily lifted out from the machine. Further, means are carried on the hook support plate for adjusting and maintaining tension on a timing belt drive means for the hook mechanism.

11 Claims, 3 Drawing Figures

HOOK DRIVE FOR SEWING MACHINES

BACKGROUND OF THE INVENTION

Typical hook drive mechanisms which are known in the art may be of the belt driven type which are illustrated in U.S. Pat. Nos. 3,382,826 and 3,476,067 each of which is assigned to the assignee of the subject invention. As illustrated in each of these patents, the hook and its driving mechanism are usually firmly secured together as by pins or screws or the like and the interconnection between the elements comprising the drive mechanism can be somewhat complicated. Further, removal of the hook from its associated drive mechanism in order to take the hook out of the sewing machine, if necessary, may become somewhat of a time consuming task because of the manner in which the hooks are supported in the sewing machine with the associated mechanism of the hook and the bed portion of the sewing machine frame. As will be apparent hereandafter, it is a purpose of the present invention to provide a relatively simple hook drive mechanism in which the hook and bobbin may be easily and readily removable from the machine and further in which the drive mechanism to the hook is relatively simple as viewed from its manufacturing, assembly and hook timing aspects.

GENERAL DESCRIPTION OF THE INVENTION

The invention is generally carried out by providing a hook support plate which is removably secured in the bed portion of the sewing machine and is provided with a bearing support means which may be in the form of an upstanding bushing for receiving the hook and a hook drive member. The hook and the hook drive member are freely supported in the bearing means for easy removal therefrom and for rotation with respect to the bearing means. The hook drive member is provided with an upstanding dog portion which is disposed for mating engagement with a slot in the body of the hook member. The hook drive member is also provided with a sprocket to which is connected a timing belt driven by a suitable power source so that driving motion is transmitted from the hook drive member through the dog to the hook member itself. A cover plate is disposed over the hook member and supported by the hook support plate and carries a movable hook retaining means. The retaining means is pivotally supported on the cover plate and engages the bobbin case which is disposed in the body of the hook member and when in restraining position maintains the hook member in driving engagement with the hook drive member and thereby restrains the hook member from vertical movement with respect to the hook support plate. Also supported on the hook support plate is an idler pulley support plate having an idler pulley carried thereby for engagement with one side of the timing belt to maintain tension thereon. The idler pulley support plate is adjustable relative to the hook support plate and further is supported by the hook plate for movement therewith such that when the hook support plate, which may be pivoted with respect to the frame portion of the machine, is pivoted for adjusting the hook point-to-needle relationship will move with the hook support plate in a manner to maintain tension on the timing belt. Accordingly, it is one object of the invention to provide a novel and improved hook drive mechanism wherein the hook member is readily removable from the hook drive assembly and is relatively easy to manufacture, assemble and to maintain the elements in timed relationship during operation thereof.

Other objects and advantages of the invention will be best understood on reading the following detailed description with the accompanying drawings.

DETAILED DESCRIPTION OF THE PREFERRED EMBODIMENT

Figure 1:
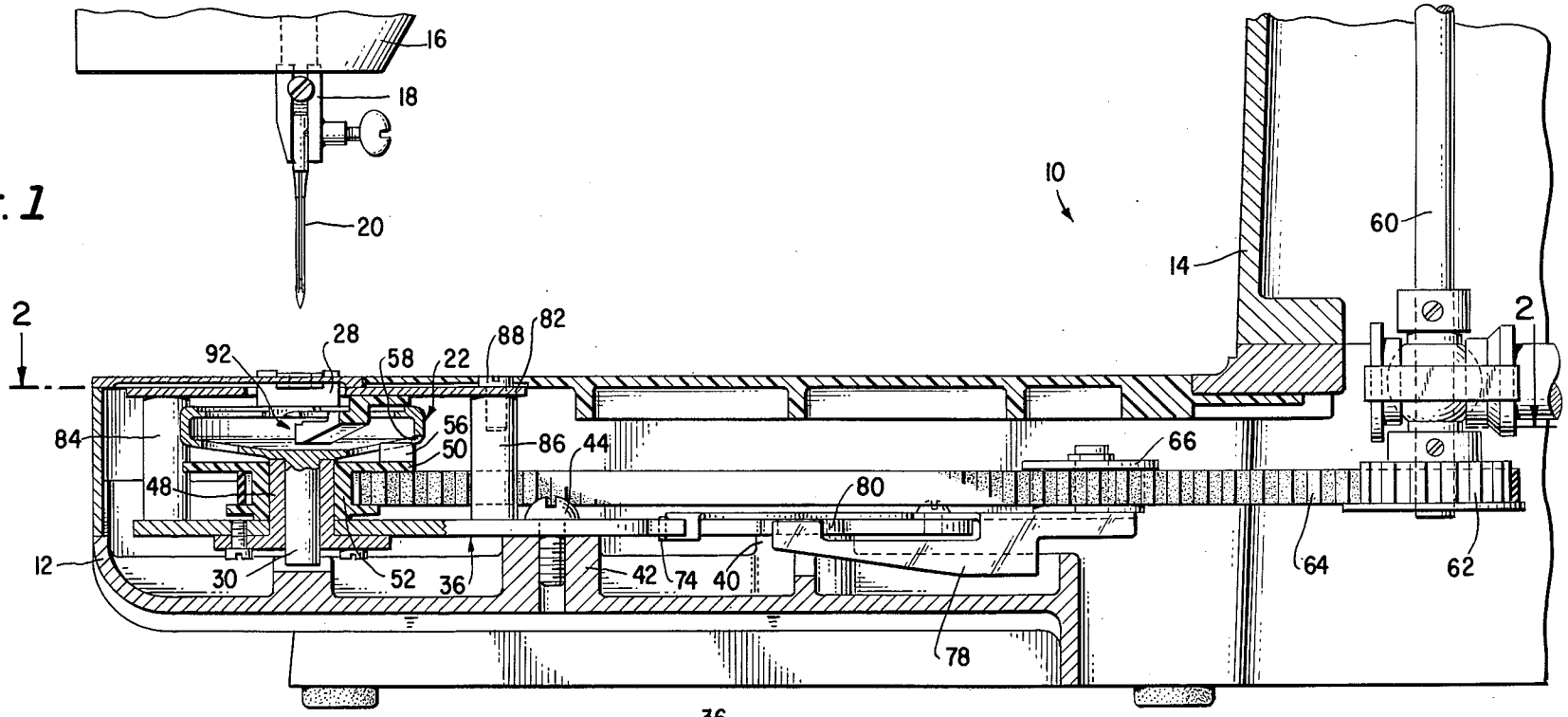
FIG. 1 is an axial sectional view of a portion of a sewing machine illustrating the invention therein.

Referring to FIG. 1, a portion of a sewing machine 10 is illustrated therein as including a bed portion 12 having an upstanding standard 14 extending therefrom which interconnects with an overhanging arm portion (not shown) which in turn terminates in a head portion 16 containing a reciprocating needle mechanism 18 including the needle 20. As is well known in the sewing machine art, an electric motor or the like may be provided for imparting drive power to the machine which electric motor is generally connected to a main shaft in the arm portion of the machine with a crank mechanism being connected thereto for reciprocating the needle in its up and down relationship with respect to the bed portion of the machine to carry a thread through a fabric in the sewing operation. Supported within the bed portion 12 is a vertical axis rotary hook 22 having a hook point or beak 24 for seizing a loop of thread thrown out by the needle 20 during its penetration of the fabric and carries the thread around a thread carrying bobbin (not shown) which is contained within a bobbin case 26 supported in the body of the hook 22 such that the needle thread is concatenated with the bobbin thread to form lockstitches in a well known manner. As is also usual practice in sewing machines, a feed mechanism is provided for feeding the fabric through the machine and includes a feed dog 28 which has a reciprocating motion for feeding the fabric across the surface of the bed portion so that continuous stitches may be made in the fabric. For purposes of convenience of illustration the drive mechanism for the feed dog 28 has been eliminated from the drawings but any suitable type of mechanism for driving the feed dog 28 may be provided.

Figure 3:
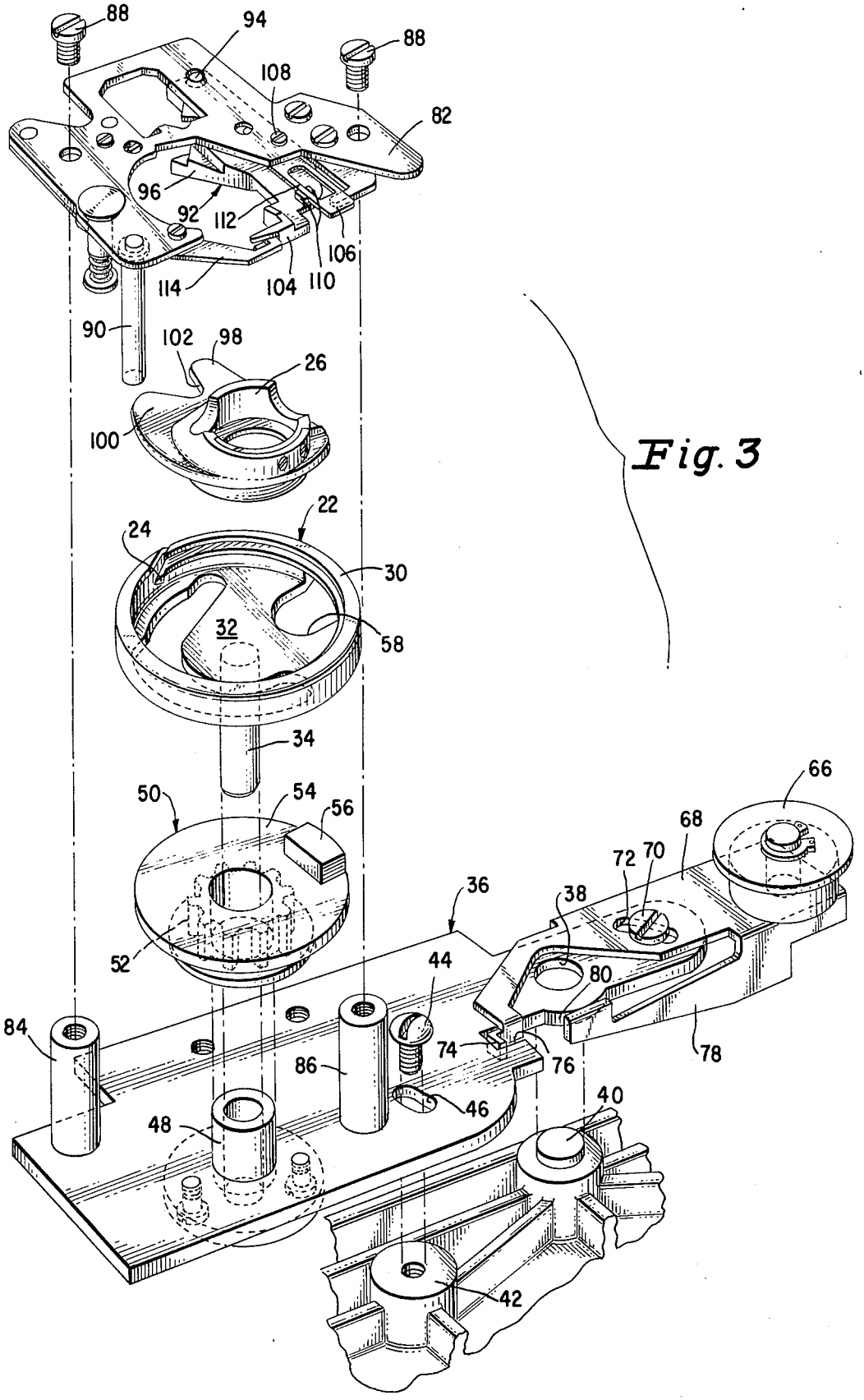
FIG. 3 is an exploded perspective view showing the elements of the combination of the invention.

Referring in particular to FIGS. 1 and 3, it will be seen that the hook member 22 further includes a cup-shaped body portion 30 with a bottom surface 32 and a depending pivot shaft portion 34 extending therefrom. In order to support the hook 22 in the machine according to the present invention, a hook support plate 36 having a circular aperture 38 is provided and accomodates a boss 40 extending upwardly from the interior bottom surface of the bed portion 12. Through this construction, the hook support plate 36 may be pivoted with respect to the boss 40 and bed portion 12 the purpose of which will be more fully explained hereinafter. In order to lock or fix the hook support plate in position with respect to the bed portion 12, a threaded boss 42 is provided in the same surface of the bed portion 12 as the boss 40 but spaced therefrom for receiving a locking screw 44 through an aperture 46 in the hook support plate 36. Therefore, after adjustment of the hook support plate it may be locked in position by tightening down the screw 44 to the threaded boss 42. Adjacent one end of the hook support plate 36 is an upstanding bushing 48 which may be fixed to the hook support plate 36 by screws or the like or be formed intergal with the hook support plate 36. As best seen in FIGS. 1 and 3, the upstanding bushing 48 is adapted for freely receiving the shaft portion 34 of the hook 22 such that the hook may rotate freely with respect to the bushing 48 and may be readily removed therefrom.

In order to drive the hook member 22 in timed relationship to the reciprocation of the needle 20 for forming stitches, a hook drive member 50 is provided and includes a hollow shaft portion 52 whose outer peripheral surface may be formed as a sprocket and whose hollow portion is of sufficient size to pass over the outer peripheral surface of the upstanding bushing 48. The hook drive member 50 is therefore freely supported with respect to the bushing 48 and may freely rotate with respect thereto and is readily removable therefrom. As best shown in FIG. 3, the hook drive member 50 is also provided with an annular disc like top portion 54 having a dog or lug 56 extending from the top surface thereof. The dog 56 is formed so as to be accomodated in an aperture or slot 58 in the bottom portion 32 of the hook body 30. Thus when these elements are assembled, the dog portion 56 will be disposed in driving engagement with the hook 22 due to the relationship of the dog 56 in the slot 58 and any motion imparted to the drive member will also be imparted to the hook member. Rotary motion is imparted to the hook assembly from the motor and main shaft of the machine as through a vertically upstanding shaft 60 disposed in the standard portion 14 of the machine and interconnected with the main shaft as through gears or the like in a known manner. A sprocket 62 is carried by the shaft 60 and supports thereon a timing belt 64 which is also disposed in driving engagement with the sprocket formation on the shaft portion 52 of the hook drive member 50. Therefore rotary motion imparted to the shaft 60 will be transmitted by way of the timing belt 64 to the drive member 50 and to the hook 22 because of the interconnection of the hook drive member and a hook member as described above.

Figure 2:
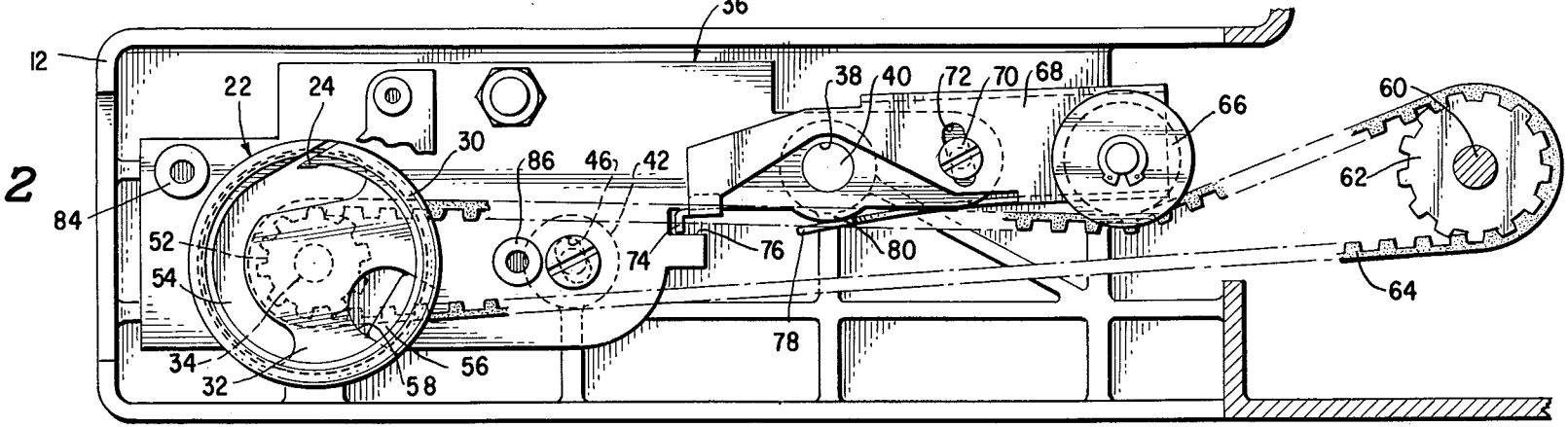
FIG. 2 is a top plan view of a portion of the bed portion of the sewing machine taken along line 2—2 of FIG. 1.

Referring in particular to FIGS. 2 and 3, an idler pulley 66 is provided for taking up any slack in the timing belt 64 and for maintaining tension thereon. The idler pulley 66 is supported on an idler support plate 68 which is carried on one end of the hook support plate 36 and is secured to the hook support plate 36 by means of a screw 70 threaded into the hook support plate 36 through an elongated slot 72 in the idler support plate. The idler support plate 68 is also formed with a locking finger 74 disposed in a slot 76 in the hook support plate 36 for holding the idler support plate at one end thereof during pivotal adjustment of the idler support plate 68 relative to the hook support plate 36. An elongated finger member 78 is disposed in abutting engagement with a rounded bump portion 80 on the hook support plate 36. The finger member 78 along with the idler support plate 68 is formed from a spring steel material so that when the idler support plate is adjusted relative to the hook support plate 36 by pivoting the idler support plate 68 about the pivot point formed by the finger 74, a spring tension will develop in the finger 78 due to its relationship with the bump portion 80 and thus maintain a spring tension relationship between the idler pulley 66 and the timing belt 64. Even when the proper adjustment of the idler support plate is made relative to the hook support plate by means of loosening fastening screw 70 and pivoting the plate 68, a limited amount of movement is possible about the screw 70 because of the relationship of the spring finger element 78 and the bump 80 which provides for a certain amount of give and return between the pulley 66 and the timing belt 64.

A hook mechanism cover plate 82 is provided (FIG. 3) which has for one purpose the maintainence of the components of the hook mechanism in the desired vertical relationship with one another. The hook mechanism cover plate 82 is supported in overlying engagement with the components of the hook mechanism by means of upstanding threaded bushings 84 and 86 extending from the top surface of the hook support plate 36 into which may be threaded screws 88 through suitable apertures positioned in the cover plate 82 for fastening the same to the hook support plate 36. Support posts such as those shown at 90 may also be provided on the cover plate 82 for supporting the cover plate on the hook plate 36 so as to prevent any undesirable rocking motion or other movement. As will be apparent from FIGS. 1 and 3, when the mechanism is assembled with the hook cover plate 82 supported on the bushings 84 and 86, the cover plate will overlie the bobbin case 26 the hook 22 and the drive member 50. A restraining means is provided such that when the elements are in the assembled condition described above, the hook member 22 will be maintained in driving relationship with the drive member 50. In otherwords, the restraining means prevents any vertical separation between the hook member 22 and the drive member 50.

As is also well known in the art, the hook 22 is rotatable relative to the bobbin case with its bobbin (not shown) so that the thread loop seized by the beak 24 of the hook 22 may be passed around the bobbin and the bobbin case for concatenation with the bobbin thread. Therefore, means are provided for maintaining the bobbin and its bobbin case stationary relative to the rotating hook member. As stated above, the bobbin case 26 is supported within the cup-shaped body portion 30 of the hook 22. In order to hold the bobbin case 26 stationary along with the bobbin, a restraining means is provided which includes a pivotal restraining member 92 which is pivotally supported on a fixed pin 94 at one end thereof which pin 94 may be suitably fixed or attached to a portion of the frame or other relatively stationary mechanism of the machine. The restraining member 92 has an abutment or cam surface 96 formed thereon which is positioned so that it will mate with a finger or camming element 98 on the bobbin case 26. A second cam surface 100 is also provided on the bobbin case 26 which is non-concentric with the inner surface of the hook body portion 30 so that rotation of the hook in a counter-clockwise direction as viewed in FIG. 3 will bring about a contact between the surface 100 of the bobbin case 26 and the inner surface of the hook body 30 while rotation in a clockwise direction will bring about an abutment between the cam surface 96 of the restraining member 92 in the cam finger 98 of the bobbin case. The bobbin case is also provided with an indentation 102 between the cam fingers 98 and 100 to permit passage of the needle therebetween for operative relationship with the hook beak 24. Thus it will be seen, that the bobbin case 26 will be restrained from rotation relative to the hook 22 during operation of the machine.

The restraining means also includes means for maintaining the hook 22 and drive member 50 in their vertical operative relationship. As best seen also in FIG. 3, the restraining member 92 also includes a forked finger member 104 disposed in overlying relationship with the bobbin case 26 and hook body 30. A latch member 106 is fixed to the underside of the cover plate 82 by a set screw 108 and is formed of spring steel so that it will bear down against the restraining member 92. A pair of spaced lugs 110 are provided on the upper surface of the restraining member 92 and are adapted for receiving a leg 112 of the latch member 106. When it is desired to maintain the hook member 22 and the drive member 50 in operative engagement, the latch member 106 may be lifted against its spring tension so that the restraining member 92 may be pivoted about the pivot pin 94 to bring the restraining member to an overlying position with respect to the hook and drive member and then the latch member may be released so that the leg 112 lies between the lugs 110 to lock the restraining member in the restraining position. As also shown in FIG. 3 a finger member 114 may be fixed to the underside of the cover plate 82 by a screw which finger member is positioned so as to lie between the forked end of the finger 104 of the restraining means 92. This serves to limit the rotation of the restraining member 92 and aid in supporting the same. Should it be desired to remove the bobbin and/or the bobbin case 26 during use of the machine, the latch member 106 may be lifted to pivot the finger 104 of the restraining member 92 in a counterclockwise direction so that the finger 104 will be moved out of overlying engagement with the bobbin case and the hook body 30.

It will be further seen that the entire hook mechanism is readily removable from the machine for maintenance or repair or replacement of the hook 22, if desired. By removal of the screws 88 the top cover of the bed portion may be removed for easy access to the cover plate 82 and other mechanisms. The top cover plate 82 may be relatively easily lifted from the machine to provide access to the bobbin, hook 22 and drive member 50. Since these components are not fastened together by any means such as screws or the like and are freely supported with respect to one another the operator need merely lift each mechanism out. When replacing the components the drive member is slid over the outer surface of the bushing 48, the hook member is dropped through the bore in the center of the bushing 48 and the bobbin case and the bobbin are laid into the hook body 30. The cover plate 82 is then overlaid with respect to the other assembled components and the machine top cover placed thereon with the screws 88 being fastened into the threaded bore of the posts 84 and 86 to thus accomplish the complete reassembly of the hook drive mechanism.

It will also be seen that a relatively simple means is provided for adjusting the hook point-to-needle relationship. As is well known in the sewing art, it is important that the hook beak be properly positioned with respect to the path of needle travel so that the thread loop thrown out by the needle may be seized by the hook beak during its rotation thereof each time a thread loop is presented. Thus means must be provided for insuring that this relationship is properly adjusted and maintained. As briefly described above, the support plate 36 is supported with respect to the machine frame so that it may be pivoted for such adjustment. When it is desired to accomplish such adjustment, the screw 44 which secures the hook support plate 36 to the frame may be loosened and the entire support plate pivoted about the pivot point formed by boss 40 and aperture 38 in the hook support plate 36. When the proper position is reached the screw 44 is tightened into the boss 42 to lock the hook support plate in the properly adjusted position. During such adjustment of the hook support plate and the hook 22 with respect to the needle 20, because of the relationship of the idler pulley support plate on the hook support plate 36, the adjustment of the hook point-to-needle need not affect the pressure of the idler pulley 66 on the timing belt 64.

From the above detailed description of a preferred embodiment of the invention it will be seen that a novel hook drive mechanism is provided which is readily accessible, easy to repair and maintain as well as adjust and is still relatively simple in construction. The components of the hook mechanism are freely supported with respect to each other and do not require any elaborate or critical fastening means to maintain the operative relationship with respect to one another. While the invention has been described in its preferred embodiment, it will be obvious to those skilled in the art that various changes and modifications can be made therein without departing from the spirit and scope of the invention as set forth in the appended claims.

Having thus described the nature of the invention what is claimed is:

1. A hook drive mechanism for a sewing machine including a frame having a bed portion, a reciprocating needle mechanism, a hook mechanism disposed in said bed portion for cooperation with said needle mechanism for forming stitches, said hook drive mechanism comprising a hook support plate disposed in said bed portion and including a hook drive mechanism bearing means, a hook member having a hook body portion and shaft portion depending therefrom, said shaft portion being freely supported by said bearing means, a hook drive member freely supported by said bearing means, means for initiating rotation of said drive member, interdigitation means on said hook member and said hook drive member freely shiftable into and out of drivingly interconnecting said drive member with said hook member, said hook member and said drive member being freely removable from said bearing means and from each other.

2. A hook drive mechanism as recited in claim 1 further comprising restraining means for maintaining said hook member and said drive member in driving engagement in one position thereof and for permitting disengagement of said hook member from said drive member in a second position thereof.

3. A hook drive mechanism as recited in claim 2 wherein said hook member includes a cup-shaped body portion, a stationary bobbin case disposed in said cup-shaped portion, and said restraining means including means for preventing rotation of said bobbin case when in said one position.

4. A hook drive mechanism as recited in claim 3 wherein said restraining means comprises a pivotal restraining member and latch means for latching said restraining member in said one position.

5. A hook drive mechanism as recited in claim 3 further comprising a hook drive mechanism cover plate, said cover plate being disposed in overlying relationship with said bobbin case and said hook member, said pivotal restraining member being pivotally secured to said cover plate, and said cover plate including an aperture therein for permitting removal of said bobbin case when said restraining member is in said second position.

6. A hook drive mechanism as recited in claim 1 wherein said hook support plate is supported for movement relative to said bed portion such that said hook support plate with said hook member is adjustable relative to said needle mechanism.

7. A hook drive mechanism as recited in claim 6 wherein said drive member includes a driving sprocket fixed thereto, and a timing belt interconnecting said driving sprocket and a machine drive means for initiating rotation of said drive member.

8. A hook drive mechanism as recited in claim 7 further comprising timing belt tension means including a rotatable idler pulley for engaging one side of said timing belt for exerting tension thereon, an idler pulley support plate for supporting said idler pulley and being secured to said hook support plate and adjustable therewith.

9. A hook drive mechanism as recited in claim 8 wherein said idler pulley support plate is adjustably secured to said hook support plate for varying the tension on said timing belt.

10. A hook drive mechanism as recited in claim 1 wherein said interdigitation means comprises a dog member disposed on said drive member, and a slot disposed in said hook member for receiving said dog member in driving relationship therewith.

11. A hook drive mechanism as recited in claim 1 wherein said hook drive mechanism bearing means comprises an upstanding bushing containing a bore fixedly attached to said hook support plate, said upstanding bushing being adapted for rotatably receiving and supporting said drive member and said shaft portion of said hook member, said drive member and said hook member being freely removable from said bushing.

* * * * *